US010490981B1

(12) United States Patent
Dirumdam

(10) Patent No.: US 10,490,981 B1
(45) Date of Patent: Nov. 26, 2019

(54) SPARK PLUG FOR AN INTERNAL COMBUSTION ENGINE WITH REDUCED RISK OF CENTER ELECTRODE DETACHMENT

(71) Applicant: MAN Energy Solutions SE, Augsburg (DE)

(72) Inventor: Björn Dirumdam, Ellgau (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 16/401,483

(22) Filed: May 2, 2019

(30) Foreign Application Priority Data

May 3, 2018 (DE) ..... 10 2018 110 580

(51) Int. Cl.
*H01T 13/54* (2006.01)
*H01T 13/32* (2006.01)
*H01T 13/16* (2006.01)
*H01T 13/39* (2006.01)

(52) U.S. Cl.
CPC ..... *H01T 13/39* (2013.01); *H01T 13/32* (2013.01)

(58) Field of Classification Search
CPC ..... H01T 13/34; H01T 13/52; H01T 13/467
See application file for complete search history.

(56) References Cited

U.S. PATENT DOCUMENTS 7,615,914 B2 * 11/2009 Francesconi ..... H01T 13/54 313/118
8,044,560 B2 * 10/2011 Steigleman, Jr. ..... H01T 13/20 313/118
9,564,740 B2 * 2/2017 Niessner ..... H01T 13/32

FOREIGN PATENT DOCUMENTS

DE 10 2011 077 279 12/2012
DE 10 2012 208 069 11/2013

* cited by examiner

*Primary Examiner* — Tracie Y Green
(74) *Attorney, Agent, or Firm* — Cozen O'Connor

(57) ABSTRACT

A spark plug for an internal combustion engine, having a center electrode, which has a first body and a second body that is a precious metal welded to the first body and a ground electrode arranged roundabout the center electrode so that an annular ignition gap is formed between the electrodes. The second body of the center electrode is formed as an annular element having a central recess. The first body of the center electrode has a projection that extends into the recess of the second body. A first weld seam is formed between a radially outer surface of the projection of the first body and a radially inner surface of the second body delimiting the recess of the second body, and a second weld seam is formed between an axial surface of the main body of the first body and an axial surface of the second body.

9 Claims, 1 Drawing Sheet

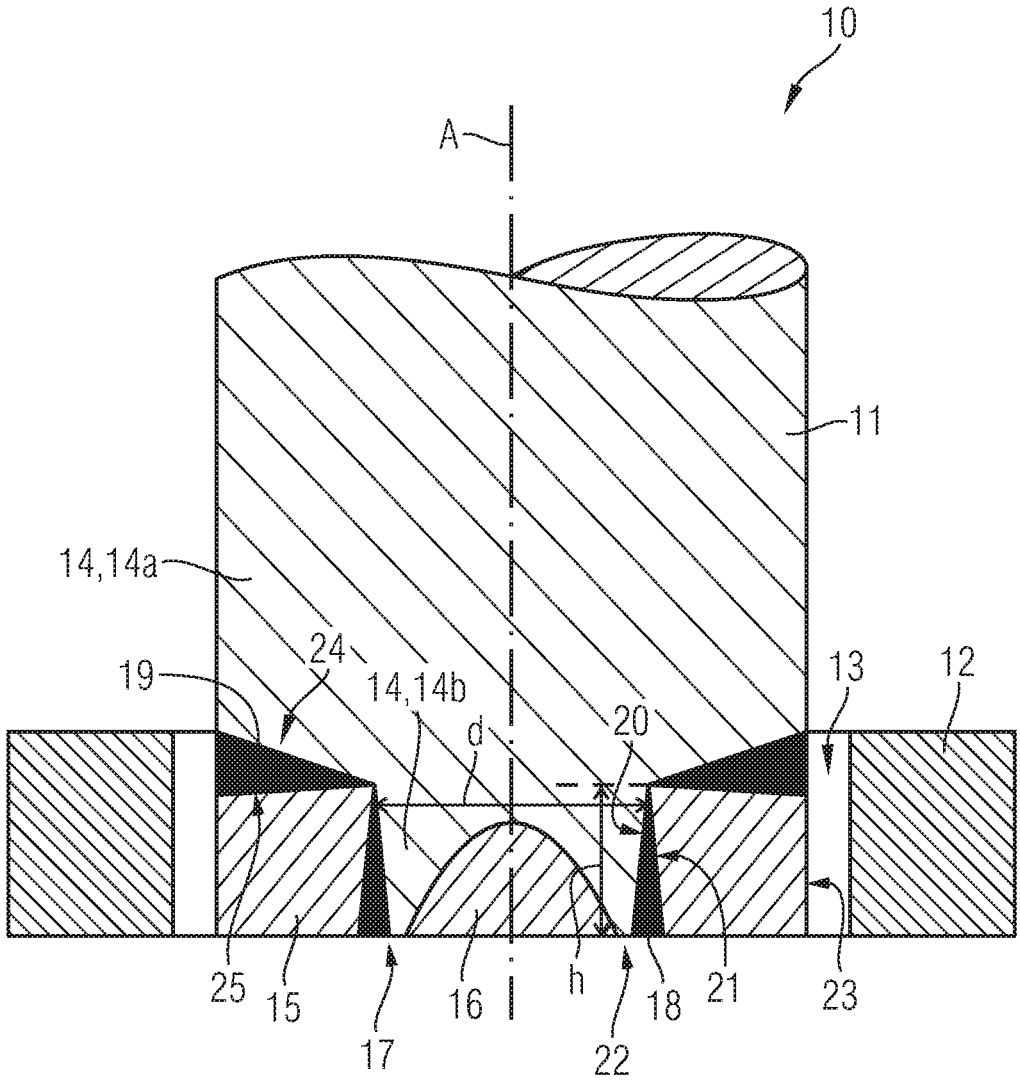
10
A
11
14,14a
24
14,14b
19
13
12
d
20
25
15
17
16
h
18
21
23
22

SPARK PLUG FOR AN INTERNAL COMBUSTION ENGINE WITH REDUCED RISK OF CENTER ELECTRODE DETACHMENT

BACKGROUND OF THE INVENTION

1. Field of the Invention

The invention relates to a spark plug for an internal combustion engine.

2. Description of the Related Art

Spark plugs serve for electrically igniting a fuel mixture to be combusted in an internal combustion engine. Between a so-called center-electrode and a so-called earth electrode of a spark plug an ignition gap is formed, in which an electric ignition spark can form for igniting the fuel mixture.

Spark plugs are basically distinguished between spark plugs having a hook-shaped earth electrode and spark plugs having an annular earth electrode. Accordingly, DE 10 2011 0277 279 A1 shows a spark plug whose earth electrode is formed hook-like, wherein the ignition gap seen in the axial direction of the center electrode extends axially between an end of the center electrode and an end of the hook-like earth electrode. A spark plug having an annular earth electrode is known from DE 10 2012 208 069 A1, wherein the ignition gap then extends between the center electrode and the earth electrode roundabout the center electrode.

From practice it is known that an earth electrode is composed of two bodies, namely of a first body, which is produced from a basic electrode material, and of a second body, which is produced from a precious metal, wherein the two bodies are welded together.

With spark plugs known from practice there is the risk that the two bodies of the center electrode become detached from one another and the second body produced from precious metal enters the combustion chamber of the cylinder comprising the spark plug and under certain condition is discharged out of the combustion chamber into the exhaust system of the internal combustion engine. This can cause damage to the internal combustion engine.

There is therefore a need for a spark plug with which the risk that the bodies of the center electrode become detached is reduced.

SUMMARY OF THE INVENTION

The invention present here relates to a spark plug having an annular earth electrode, i.e. an ignition gap extending in the radial direction roundabout the center electrode.

One aspect the invention is based on creating a new type of spark plug for an internal combustion engine. According to one aspect of the invention, the second body of the center electrode is designed as an annular element with a central recess. The first body of the center electrode comprises a main body and a projection, which extends into the recess of the second body. A first weld seam is formed between a radially outer surface of the projection of the first body and a radially inner surface of the second body delimiting the recess of the second body. A second weld seam is formed between an axial surface of the main body of the first body and an axial surface of the second body.

Through the configuration of the center electrode of the spark plug out of the first body comprising the projection and the second body formed as an annular element according to the invention, and through the joining of these two bodies by way of the two weld seams, the risk that the second body becomes detached from the first body and causes damage to the internal combustion engine is significantly reduced. The two weld seams increase the weld area and can be reliably formed by simple welding.

According to an advantageous further development of the invention, the first weld seams extends seen in the axial direction emanating from an end face of the center electrode into the same. The second weld seam extends seen in the radial direction emanating from a circumferential surface of the center electrode into the same. This orientation of the two weld seams increases particularly advantageously the weld area that is available and allows a reliable forming of the two weld seams.

Preferentially, the diameter d of the projection and the axial extension h of the projection are dimensioned so that the following applies: d 8*h*. This feature also serves for enlarging the weld area that is available.

Preferentially a material recess is introduced into an end face of the projection of the first body. By way of the material recess, a stress reduction in the welding zone can be provided, as a result of which the risk that the welded connection between the two bodies of the center electrode, which are produced from different materials and accordingly have different heat expansion coefficients, is undone.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

The FIGURE is a schematised representation of a spark plug according to one aspect of the invention.

DETAILED DESCRIPTION OF THE PRESENTLY PREFERRED EMBODIMENTS

One aspect of the invention present here relates to a spark plug for an internal combustion engine, in particular for a spark-ignition gas engine, which serves for igniting a fuel mixture to be combusted in the internal combustion engine.

The FIGURE shows a schematised extract from a spark plug 10 in the region of a center electrode 11 and an earth electrode 12 arranged in the radial direction roundabout the center electrode 11. Between the center electrode 11 and the earth electrode 12 an annular ignition gap 13 in the form of an annular gap or of a segmented annular gap is formed, which is provided for igniting a fuel mixture by way of an electric ignition spark forming between the center electrode 11 and the earth electrode 12.

The center electrode 11 consists of a first body 14 and a second body 15, which are joined by welding. The first body 14 consists of an electrode base material. The second body 15 consists of a precious metal.

To ensure a good bond between the two bodies 14, 15 of the center electrode 11 and to reduce the risk that the second body 15 consisting of the precious metal is detached from the first body 14 consisting of the electrode base material, it is provided according to the invention that the first body 14 of the center electrode 11 has a main body 14*a* and a projection 14*b* which with respect to the main body 14*a* projects in the axial direction A. The second body 15 is formed as an annular element with a central recess 17, into which the projection 14*b* of the first body 14 extends.

For joining second body 15 and first body 14, two weld seams 18, 19 are formed. A first weld seam 18 is formed between a radially outer surface 20 of the projection 14*b* of the first body 14 and a radially inner surface 21 of the second body 15 delimiting the recess 17 of the second body 15. This first weld seam 18 extends seen in the axial direction a emanating from an end face 22 of the center electrode 11 into the same, wherein a penetration depth of the first weld seam 18 into the center electrode 11 approximately corresponds to the axial length h of the projection 14*b* of the first body 14.

The second weld seam 19 is formed between an axial surface 24 of the main body 14*a* of the first body 14 and an adjoining axial surface 25 of the second body 15. This second weld seam 19 extends, emanating from a circumferential surface 23 of the center electrode 11, into the same, wherein the penetration depth of the second weld seam 19 corresponds to the radial distance between the circumferential surface 23 of the center electrode 11 and the projection 14*b* of the first body 14.

The first weld seam 18 extending in the axial direction into the center electrode 11, which in the circumferential direction runs about the surfaces 20, 21, is offset by approximately 90° or by 90° relative to the second weld seam 19, which is formed between the axial surfaces 24 and 25 and in the radial direction extends into the center electrode 11.

Preferentially, the projection 14*b* of the first body 14 and thus the recess 17 of the second body 15 are contoured in such a manner that the following relationship: d 8*h* applies to a diameter d of the projection 14*b* and the axial length h of the projection 14*b*.

Particularly preferably it is provided that into the end face of the projection 14*b*, which extends in the plane of the end face 22 of the center electrode 11, a material recess 16 is introduced, which is preferentially contoured parabolically.

For the center electrode 11 of the spark plug 10 according to the invention there is a reduced risk that the second body 15 of the center electrode 11 produced from precious metal becomes unintentionally detached from the first body 14 of the center electrode 11 produced from the electrode base material.

Each of the weld seams 17, 18 have a relatively low penetration depth but, combined, provide a high weld area that is available, which can be reliably formed.

By way of the optional material recess 16, stresses in the welding zone can be reduced, as a result of which the risk of a failure of the welded connection can be reduced.

A further advantage of the spark plug 10 consists in that through the recess 17 in the second body 15 of the center electrode 11, less precious metal is required. This reduces the production costs of the spark plug 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. A spark plug for an internal combustion engine, comprising:

a center electrode, comprising:

a first body formed from an electrode base material having a main body and a projection extending radially from the main body; and a second body formed from a precious metal as an annular element with a central recess, the projection extending into the central recess of the second body;

a first weld seam formed between a radially outer surface of the projection of the first body and a radially inner surface of the second body delimiting the central recess of the second body; and a second weld seam formed between an axial surface of the main body of the first body and an axial surface of the second body;

an earth electrode arranged in radially surrounding the center electrode; and an annular ignition gap formed between the center electrode and the earth electrode configured to ignite a fuel mixture by way of an electric ignition spark forming between the center electrode and the earth electrode.

2. The spark plug according to claim 1, wherein the first weld seam and the second weld seam are offset by approximately 90° or by 90° relative to one another.

3. The spark plug according to claim 1, wherein the first weld seam, seen in axially, extends from an end face of the center electrode axially into the center electrode.

4. The spark plug according to claim 2, wherein a penetration depth of the first weld seam corresponds to an axial length of the projection of the first body.

5. The spark plug according to claim 1, wherein the second weld seam, seen radially, extends from a circumferential surface of the center electrode radially into the center electrode.

6. The spark plug according to claim 5, wherein a penetration depth of the second weld seam corresponds to a radial distance between the circumferential surface of the center electrode and the projection of the first body.

7. The spark plug according to claim 1, wherein a material recess is introduced into an end face of the projection of the first body.

8. The spark plug according to claim 7, wherein the material recess is contoured parabolically.

9. The spark plug according to claim 1, wherein a diameter (d) of the projection and an axial length (h) of the projection are dimensioned so that d≤8 h applies.

* * * * *